US006973860B2

(12) United States Patent
Nish

(10) Patent No.: US 6,973,860 B2
(45) Date of Patent: Dec. 13, 2005

(54) SPLIT-TIP SCREWDRIVER WITH PROTECTIVE SLEEVE

(75) Inventor: Jeffery Lynn Nish, Centerville, UT (US)

(73) Assignee: J&M Innovative Products, LLC, Woods Cross, UT (US)

( * ) Notice: Subject to any disclaimer, the term of this patent is extended or adjusted under 35 U.S.C. 154(b) by 0 days.

(21) Appl. No.: 10/697,723

(22) Filed: Oct. 30, 2003

(65) Prior Publication Data

US 2005/0092142 A1 May 5, 2005

(51) Int. Cl.[7] ..... B25B 23/08
(52) U.S. Cl. ..... 81/443; 81/447
(58) Field of Search ..... 81/442–449, 451–455

(56) References Cited

U.S. PATENT DOCUMENTS

| | | | | |
|---|---|---|---|---|
| 1,275,810 A | | 8/1918 | White | |
| 1,432,054 A | | 10/1922 | Cuff | |
| 1,758,945 A | | 11/1928 | Grube | |
| 1,797,390 A | | 3/1931 | Wood | |
| 2,058,197 A | | 10/1936 | West | |
| 2,445,383 A | | 7/1948 | Barlow | |
| 2,576,454 A | * | 11/1951 | Gearhart | 81/442 |
| 3,120,251 A | | 2/1964 | York | |
| 3,224,479 A | * | 12/1965 | Osborn et al. | 81/443 |
| 3,604,487 A | * | 9/1971 | Gilbert | 81/443 |
| 3,900,057 A | | 8/1975 | Benitz | |
| 4,078,593 A | * | 3/1978 | Benitz | 81/443 |
| 4,542,667 A | | 9/1985 | Jang | |

OTHER PUBLICATIONS

Kedman Company advertisement for Quick Wedge, 1990.

* cited by examiner

*Primary Examiner*—Debra S Meislin
(74) *Attorney, Agent, or Firm*—Holland & Hart

(57) ABSTRACT

The present invention relates to an improved split-tip screwdriver. The split-tip screwdriver of the present invention prevents the movable sleeve from detaching from the remainder of the screwdriver by incorporating a retention rim on both the sleeve and the handle. The split-tip screwdriver also provides an extended portion on the sleeve that covers the elongated members and insulates the elongated members when the sleeve is extended from the handle to minimize the possibility of a user inadvertently being shocked by electricity conducted through the elongated members.

17 Claims, 5 Drawing Sheets

SPLIT-TIP SCREWDRIVER WITH PROTECTIVE SLEEVE

FIELD OF THE INVENTION

This invention relates to split-tip screwdrivers, and more particularly to split-tip screwdrivers for use in high voltage applications.

BACKGROUND OF THE INVENTION

Split-tip screwdrivers generally include two elongated members, a handle, and a sleeve. The two elongated members are welded together at their proximal ends and a flat driver tip is provided on each distal end. The handle fixably encloses and secures the proximal end of the two elongated members. The sleeve surrounds the two elongated members at a position between the distal end and the handle. The sleeve is movable relative to elongated members such that when the sleeve is positioned in a retracted position (i.e., abutting the handle), the driver tips on the two elongated members are laterally aligned forming a continuous, straight drive tip of constant thickness similar to a standard flat screwdriver tip. When the sleeve is extended away from the handle, the driver tips on the two elongated members are forced to move relative to each other along an inclined plane so that they overlap each other. By overlapping the drive tips in this manner, the thickness of the combined drive tip is increased allowing a screw to be secured to the end of the screwdriver without requiring a user to manually hold the screw against the drive tip. Such split-tip screwdrivers have existed for some time.

Split-tip screwdrivers are commonly used in many applications including plumbing, woodworking, and low voltage electrical work. One of the problems with traditional split-tip screwdrivers is that the sleeve can easily be removed from the two elongated members. Once the sleeve is removed it can easily be misplaced or lost rendering the screwdriver useless. In addition, traditional sleeves are relatively short such that as the sleeve is moved relative to the elongated members to increase the thickness of the combined drive tip, a portion of the elongated members between the sleeve and the handle becomes exposed. The elongated members may be conductive and therefore by exposing them between the sleeve and the handle, a user may inadvertently contact an electrical power source with the elongated members. This could create a number of problems.

There is a need in the industry, therefore, to provide a split-tip screwdriver that solves the problems described above, yet remains efficient for general use.

SUMMARY OF THE INVENTION

The present invention relates to an improved split-tip screwdriver. The split-tip screwdriver of the present invention prevents the movable sleeve from detaching from the remainder of the screwdriver by incorporating a retention notch on both the sleeve and the handle. The split-tip screwdriver also provides an extended sleeve that insulates the elongated members when the sleeve is extended from the handle to prevent the possibility of conducting electricity through the middle sections of the elongated members. The improved split-tip screwdriver also conforms to the regulations for insulated tools enabling it to be used for high voltage applications.

A first embodiment of a split-tip screwdriver in accordance with the present invention relates to providing retention ridges on the interior of the handle and the exterior of the sleeve. The retention ridges are designed to prevent the sleeve from being separated from the elongated members. When the sleeve is extended a particular distance, the retention ridges on the sleeve abut the retention ridges on the handle to prevent further extension. This embodiment solves a limitation of prior art screwdrivers where the sleeve could be separated from the elongated members and be potentially lost or misplaced.

A second embodiment of a split-tip screwdriver in accordance with the present invention relates to providing an extended sleeve which covers the elongated members even when the sleeve is in a fully extended configuration. Since the elongated members often include conductive materials, it is beneficial to insulate conductive materials to the extent possible. By providing an insulating layer, a user is less likely to receive an electric shock if he or she was to inadvertently contact the region between the sleeve and the handle. This feature also conforms to a requirement for insulated tools to be used in high voltage applications.

The discussed embodiments may be combined or incorporated independently and remain consistent with the present invention. The foregoing and other features, utilities, and advantages of the invention will be apparent from the following detailed description of the invention with reference to the accompanying drawings.

DETAILED DESCRIPTION OF THE INVENTION

Reference will now be made to the drawings to describe presently preferred embodiments of the invention. It is to be understood that the drawings are diagrammatic and schematic representations of the presently preferred embodiments, and are not limiting of the present invention, nor are they necessarily drawn to scale.

"Screwdriver" as used herein means any type of driver for a fastener, including without limitation straight-slot screwdrivers, Phillips-head screwdrivers, and socket head screwdrivers. "Drive tip" shall mean any type of tip for a screwdriver, including without limitation straight-slot drive tips, Phillips-type drive tips, and socket-type drive tips. "Split-tip" means any type of drive tip for a screwdriver that includes two or more structures that interact with each other to form the drive tip.

The present invention relates to an improved split-tip screwdriver. Split-tip screwdrivers are used to secure a screw to the drive tip of the screwdriver without requiring a user to hold the screw in front of the drive tip as the screw is being inserted into a threaded aperture. The split-tip screwdriver of the present invention prevents the movable sleeve from detaching from the remainder of the screwdriver by incorporating a retention notch on both the sleeve and the handle. The split-tip screwdriver also includes an extended portion of the sleeve to insulate the elongated members when the sleeve is extended from the handle to prevent the possibility of a user inadvertently being shocked by electricity that may be conducted through the elongated members. The improved split-tip screwdriver may thus be used in high voltage applications. Also, while embodiments of the present invention are described in the context of split-tip screwdrivers, those skilled in the art will appreciate that the teachings of the present invention are applicable to other applications as well.

Figures 1, 2:
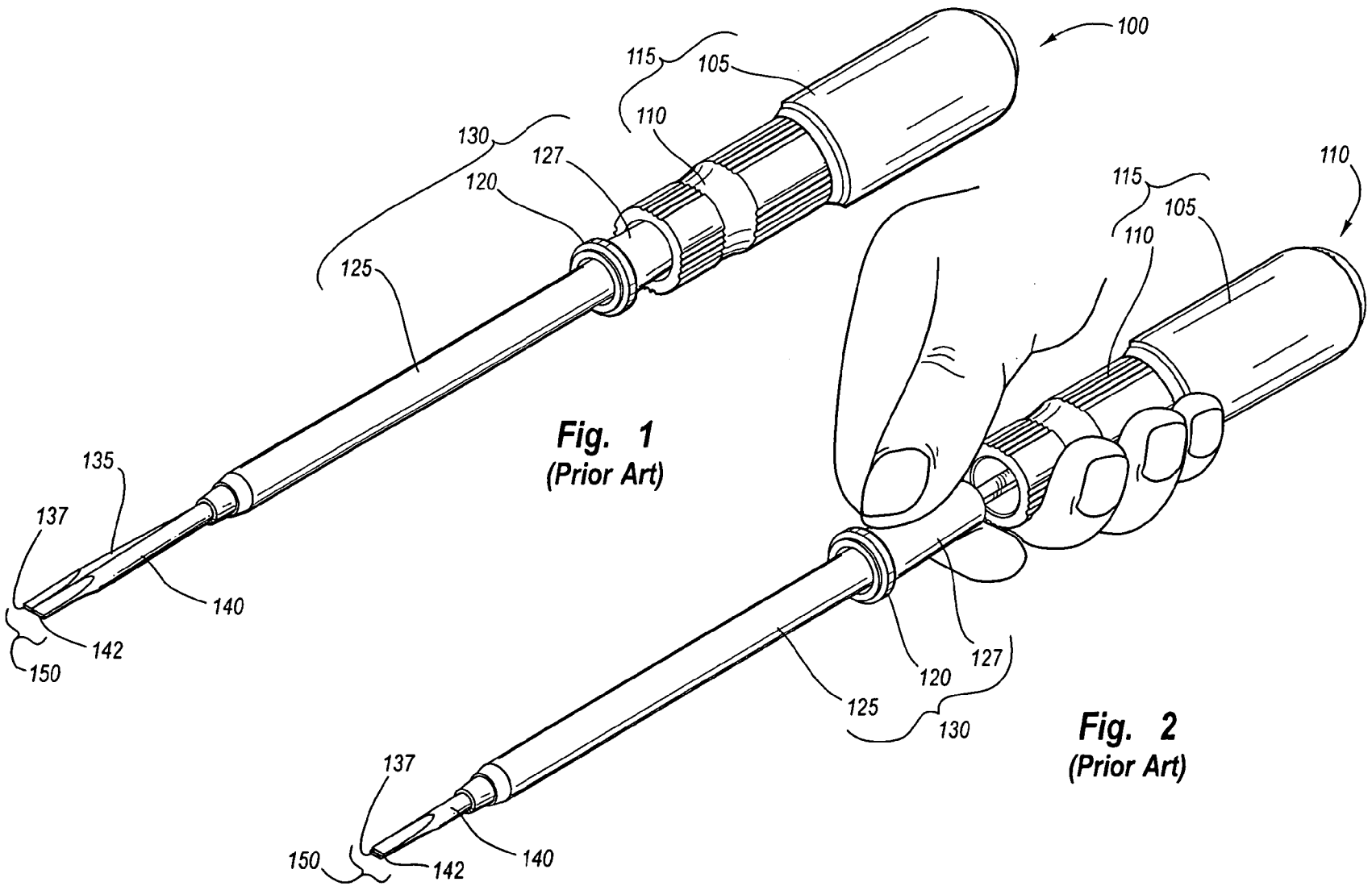
Fig. 1 (Prior Art)
Fig. 2 (Prior Art)
FIG. 1 is a perspective view of a prior art split-tip screwdriver with the sleeve in the retracted position and the drive tips forming a combined standard flat drive tip.
FIG. 2 is a perspective view of a prior art split-tip screwdriver with the sleeve in the extended position and the drive tips overlapping one another so as to increase the width or thickness of the combined drive tip.

FIGS. 1 and 2 illustrate a prior art split-tip screwdriver 100 with a sleeve section 130 in the retracted and extended configurations, respectively. The split-tip screwdriver 100 generally includes a handle section 115, a sleeve section 130, two elongated members 135, 140 which terminate at a combined drive tip 150. The handle 115 further includes a handle grip portion 105, which may comprise a relatively soft material, and a rigid portion 110 forward of the handle grip portion. The handle grip portion 105 may comprise a material including but not limited to rubber. The rigid portion 110 is designed to provide a surface with a maximum amount of grip. The rigid portion 110 may comprise a material including but not limited to plastic. Alternatively, the handle grip portion 105 and the rigid forward portion 110 may comprise the same materials.

The sleeve 130 is movable relative to the elongated members 135, 140 between a retracted position shown in FIG. 1 and an extended position shown in FIG. 2. The sleeve 130 can even be extended beyond the position shown in FIG. 2, allowing the sleeve to be completely detached from the remainder of the screwdriver 100. The sleeve 130 further includes a forward portion 125, a circumferential ring 120, and a rearward portion 127. The forward portion 125 extends distally away from the handle 115 toward the combined drive tip 150 of the screwdriver 100. The forward portion 125 has an interior cavity which is sized to compress the elongated members 135, 140 towards one another when the sleeve 130 is moved from the retracted position shown in FIG. 1 to the extended position shown in FIG. 2. The ring 120 and the rearward portion 127 prevent the sleeve 130 from being retracted too far inside of the handle 115. The rearward portion 127 is cone-shaped and tapers down proximally toward the handle 115. Either the rearward portion 127 or the ring 120 will abut the rigid portion 110 of the handle when the sleeve 130 is retracted as shown in FIG. 1. The ring 120 and the rearward portion 127 are also designed to provide a gripping surface whereby a user can extend the sleeve 130 distally away from the handle 115, as shown in FIG. 2.

The two elongated members 135, 140 are long rod like members that extend from the handle 115 and combine to form the drive tip 150. The elongated members comprise a distal end, corresponding to the drive tip 150, a proximal end held within the handle 115, and a middle section which includes all portions of members 135, 140 outside of handle 115, but covered by sleeve 130. Thus, the middle sections change depending upon the location of sleeve 130. The two elongated members 135, 140 are welded together at a location inside of handle 115. The elongated members 135, 140 are rigidly secured to the handle 115 such that they cannot be separated from the handle. Absent a sufficient compression force exerted on the elongated members 135, 140, the members 135, 140 will be aligned laterally as shown in FIG. 1. Elongated members 135, 140 comprise drive tips 137, 140. The drive tips 137, 140 are tapered end portions of the elongated members that terminate at substantially flat surfaces, including straight-slot end surfaces, similar to an end of a traditional straight slot screwdriver. The combination of the drive tips 137, 140 form the combined drive tip 150 of the screwdriver 100.

When the sleeve 130 is in the retracted position shown in FIG. 1, the combined drive tip 150 is shaped like a traditional drive tip found on a flat head screwdriver. The drive tips 137, 140 are shaped to mesh, engage, or interlock with one another along an inclined plane to form the combined drive tip 150. When the sleeve 130 is in the extended position shown in FIG. 2, a compression force is exerted on the drive tips 137, 140 causing them to move relative to the inclined plane and overlap one another. By causing the drive tips 137, 140 to overlap one another, the effective thickness or width of the combined drive tip 150 is increased. The increase in thickness of the combined drive tip 150 allows the tip 150 to place a compressive force on the sides of a slot in a straight-slot screw, which holds the screw on the tip of screwdriver 100.

Prior art split-tip screwdrivers have encountered numerous limitations, as discussed above. For example, the sleeve 130 on such prior art split-tip screwdrivers has been able to extend distally all the way down the elongated members 135, 140 to become separated from the screwdriver 100. Furthermore, when the sleeve 130 is in the extended position shown in FIG. 2, a portion of the elongated members 135, 140 is exposed between the sleeve 130 and the handle 115. If the elongated members 135, 140 contact a high voltage device, the electricity may be conducted up through the elongated members 135, 140. Thus, prior art screwdrivers, such as screwdriver 100, do not satisfy requirements for insulated tools used in high voltage applications (e.g., 10,000 volts or more).

Figures 3, 4:
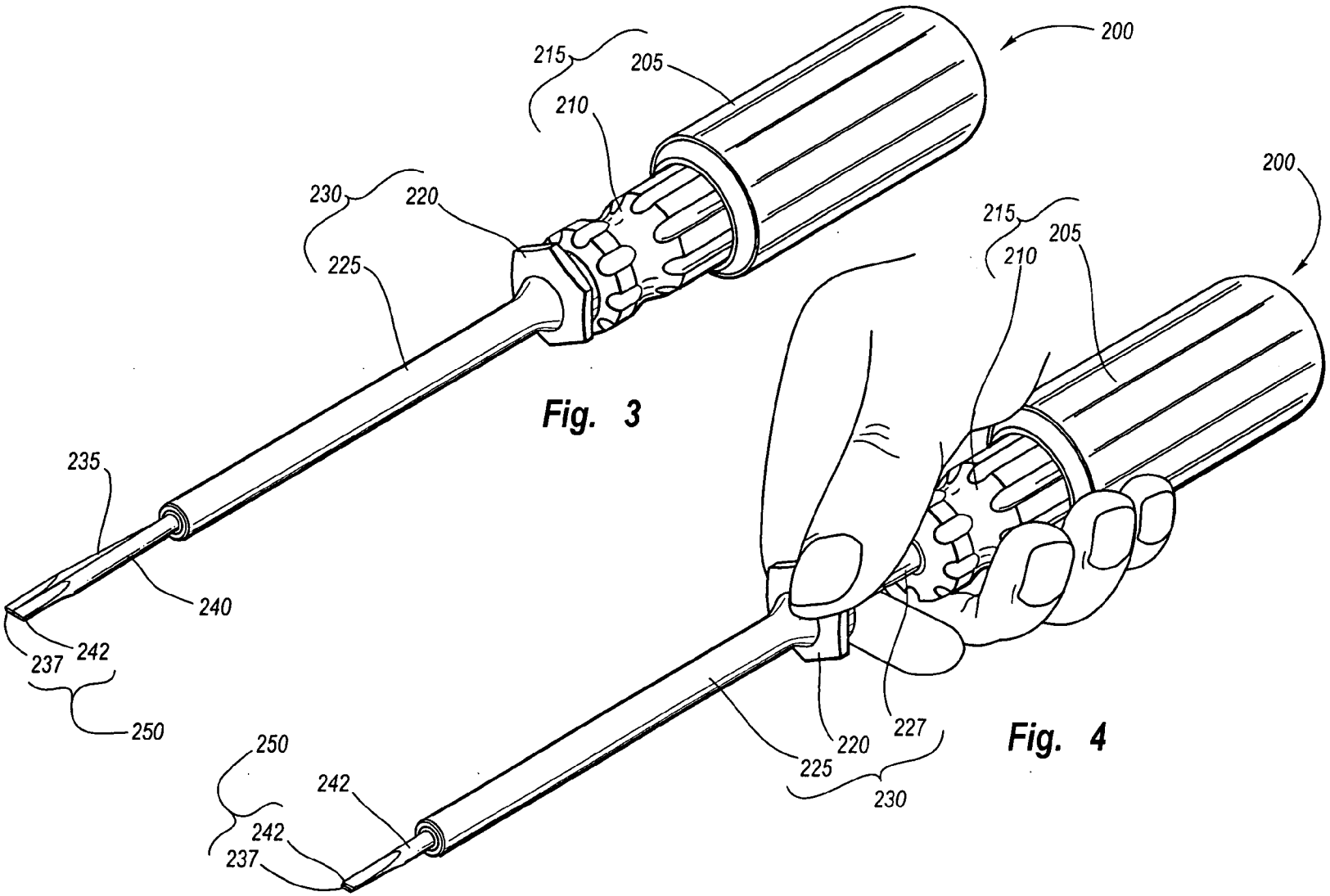
FIG. 3 is a perspective view of a split-tip screwdriver in accordance with one embodiment of the present invention wherein the sleeve is positioned in the retracted position and the drive tips form a combined standard flat drive tip.
FIG. 4 is a perspective view of a split-tip screwdriver in accordance with one embodiment of the present invention wherein the sleeve is positioned in an extended position and the drive tips overlap one another so as to increase the width or thickness of the combined drive tip.

FIGS. 3 and 4, illustrate a split-tip screwdriver 200 in accordance with one embodiment of the present invention illustrating the sleeve 230 in the retracted and extended configurations, respectively. The split-tip screwdriver 200 overcomes the limitations described above in relation to the prior art split-tip screwdriver 100. The split-tip screwdriver 200 generally includes a handle 215 having a hollow cavity or recess 228 (FIG. 6) with a tapered opening or entrance 229 (FIG. 6), a sleeve 230 having a recessable or rearward portion 227, and two elongated members 235, 240 that combine at a distal end to form a drive tip 250. The handle 215 further includes a handle grip portion 205 and a rigid portion 210. The handle grip portion 205 is designed to provide a grippable surface, and may comprise a material including but not limited to rubber. The rigid portion 210 is designed to provide a gripping surface. The rigid portion 210 comprises a material including but not limited to plastic. Alternatively, the handle grip portion 205 and the forward, rigid portion 210 may comprise the same materials.

Figure 6:
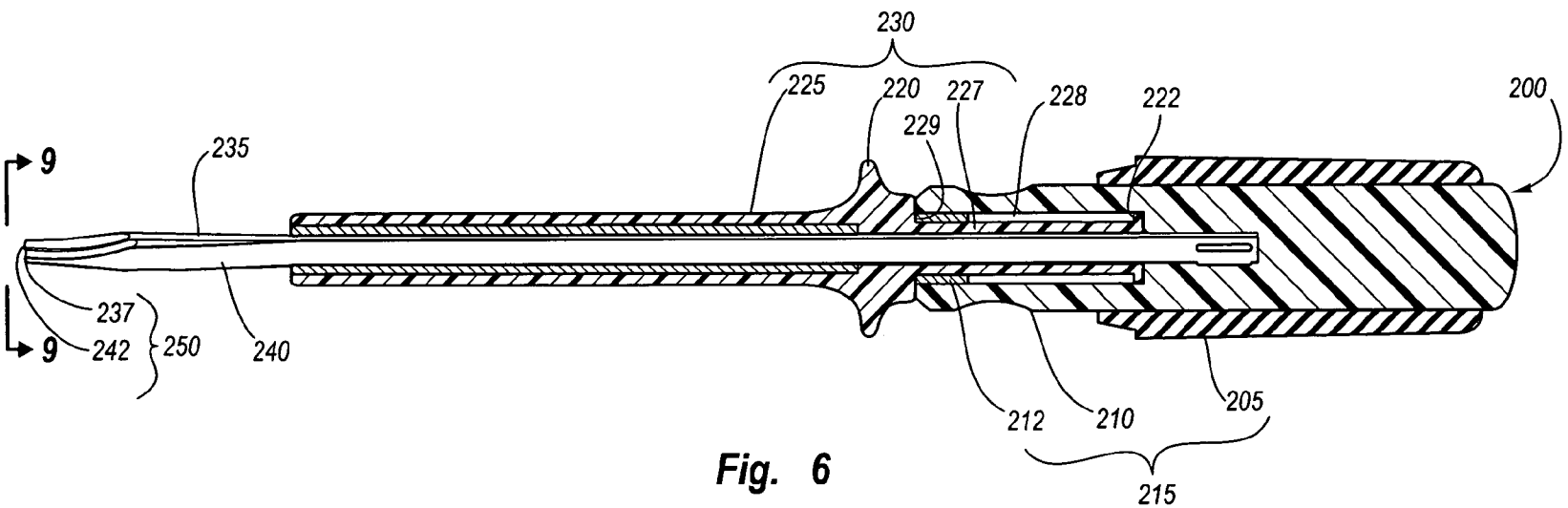
FIG. 6 is a cross sectional view of the split-tip screwdriver illustrated in FIG. 3 with the sleeve positioned in the retracted position.

The sleeve 230 is movable between a retracted position shown in FIG. 3 and an extended position shown in FIG. 4. Unlike the sleeve 130 shown in FIGS. 1 and 2, the sleeve 230 cannot be extended beyond the extended position shown in FIG. 2. The sleeve 230 further includes forward portion 225, a circumferential ring 220, the extended recessable or rearward portion 227, and a retaining rim 222. The forward portion 225 extends distally away from the handle 215 toward the combined drive tip 250 of the screwdriver 200. The elongated forward portion 225 has an interior cavity which is specifically sized to compress the elongated members 235, 240 toward one another when the sleeve 230 is moved from the retracted position shown in FIG. 3 to the extended position shown in FIG. 4. The ring 220 prevents the sleeve 230 from being retracted proximally beyond a particular point within the handle 215. The recessable or rearward extension portion 227 is substantially cylindrical and maintains a constant diameter until it terminates at the retaining rim 222 (FIG. 6). The ring 220 therefore abuts the rigid portion 210 of the handle when the sleeve 230 is retracted as shown in FIG. 3. The ridge 220 and the recessable or rearward extension portion 227 are designed to provide a gripping surface so the user can extend the sleeve 230 distally away from the handle 215 as shown in FIG. 4.

The two elongated members 235, 240 are long rod like members that extend from the handle 215 to the combined drive tip 250. The two elongated members 235, 240 are welded together at a proximal end that corresponds to the inside of handle 215 (see FIG. 6). The elongated members 235, 240 are also rigidly secured to the handle 215 such that they cannot be separated from the handle. Absent a sufficient compression force being exerted on the elongated members 235, 240, the members 235, 240 will be aligned laterally, as shown in FIG. 3. The two elongated members 235, 242 terminate at drive tips 237, 242. The drive tips 237, 242 comprise tapered portions of the elongated members that terminate at flat end surfaces, such as the ones found on traditional straight-slot screwdrivers. The combination of the drive tips 237, 242 form the combined drive tip 250 of the screwdriver 200. When the sleeve 230 is in the retracted position shown in FIGS. 3 and 6, the combined drive tip 250 takes the form of a traditional drive tip found on a straight-slot screwdriver. The drive tips 237, 242 are shaped to mesh, engage, or interlock with one another along an inclined plane to form the combined drive tip 250. When the sleeve 230 is in the extended position shown in FIG. 4, a compression force is exerted on the drive tips 237,242 causing them to overlap one another. By causing the drive tips 237, 242 to overlap one another, the effective thickness or width of the combined drive tip 250 is increased. This allows the drive tips 237, 242 of the combined drive tip 250 to grip the walls of the straight slot formed in the screw head of a screw causing it to be secured to the screwdriver 200.

Figure 8:
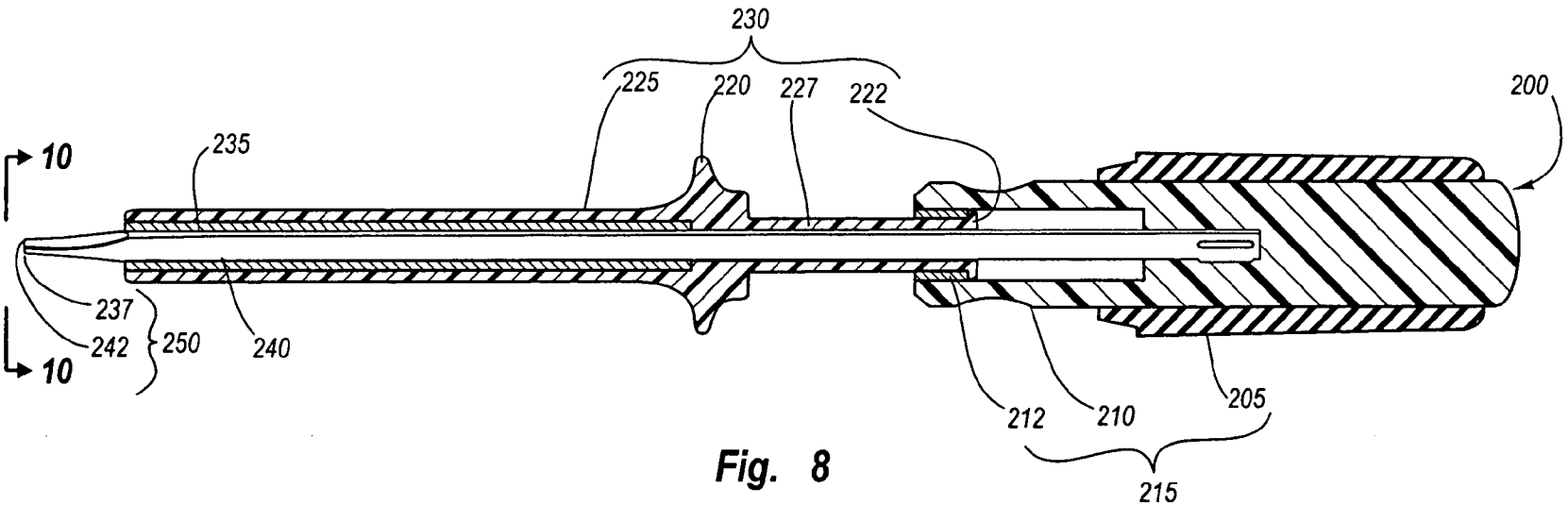
FIG. 8 is a cross sectional view of the split-tip screwdriver illustrated in FIG. 4 with the sleeve positioned in the extended position.

The split-tip screwdriver 200 in accordance with one embodiment of the present invention utilizes novel techniques to overcome the limitations of the prior art split-tip screwdriver 100. The handle 215 and the sleeve 230 include retention lips or rims 212, 222 (FIGS. 6 and 8). These retention rims 212, 222 prevent the sleeve 230 from being separated from the screwdriver 200. The retention rim 222 protruding radially from the hollow cavity 228 defines the tapered opening 229. Preferably, high voltage insulated tools should include retaining devices to prevent the tool components from becoming separated from each other. The retention rims 212, 222 therefore solve the problem of the sleeve 230 being separated from the test of the tool 200. In addition, the rearward extension portion 227 is elongated, as compared to the prior art, and thus provides a constant insulating layer that covers the elongated members 235, 240. When comparing FIG. 4 with FIG. 2, it is evident that the split-tip screwdriver 200 maintains insulation over the elongated members 235, 240 even when the sleeve 230 is in the extended position. Covering elongated members 235, 240 minimizes the possibility that user may be shocked by electricity. Thus, maintaining the rearward extension portion 227 between the retention rims or ridges 212, 222 and the remainder of the sleeve 230 therefore solves the problem of any intermediate portion of the elongated members 235, 240 being exposed, which will allow the tool 200 to be used in high voltage applications.

Figure 5:
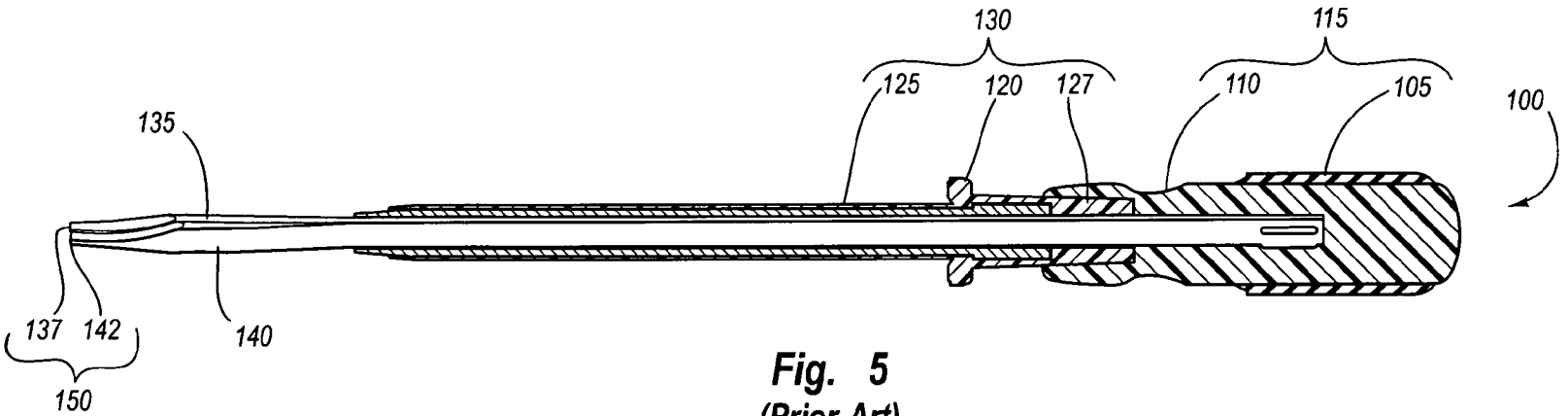
Fig. 5 (Prior Art)
FIG. 5 is a cross sectional view of the prior art split-tip screwdriver illustrated in FIG. 1 with the sleeve positioned in a retracted position.

FIGS. 5 and 6 illustrate cross sectional views of the prior art screwdriver 100 and the improved screwdriver 200 with the sleeve in the retracted position. In the retracted position, the prior art screwdriver 100 and the screwdriver 200 in accordance with the present invention both perform the same function. Both screwdrivers 100, 200 maintain insulation over a majority of their respective elongated members 135, 140, and 235, 240 and create respective combined driver tips 150, 250, which are substantially flat. With respect to the screwdriver 200 in accordance with the present invention, the sleeve 230 is prevented from further recessing into the handle 215 by an abutment between the ridge 220 of the sleeve 230 and the rigid portion 210 of the handle 215. It should be noted that the presence of the retention rims 212, 222 on the handle 215 and the sleeve 230, respectively, is a significant difference as compared to the prior art.

Figure 7:
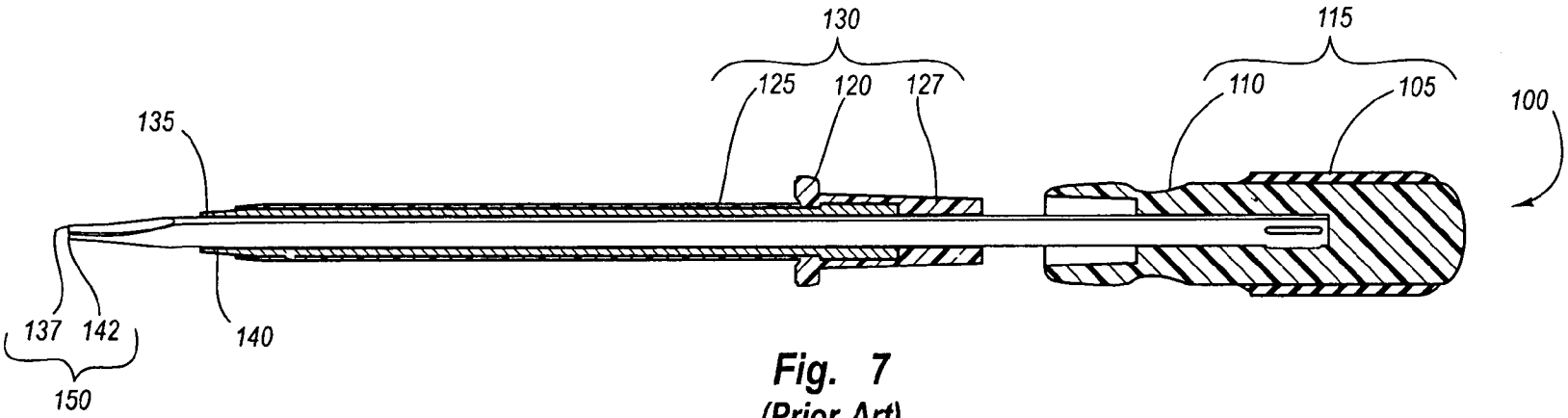
Fig. 7 (Prior Art)
FIG. 7 is a cross sectional view of the prior art split-tip screwdriver illustrated in FIG. 2 with the sleeve positioned in the extended position.

FIGS. 7 and 8 illustrate cross sectional views of the prior art screwdriver 100 and the improved screwdriver 200 with the sleeve in the extended position. In the extended position of the sleeve 130, the prior art screwdriver 100 exposes a middle portion of the elongated members 135, 140 between the sleeve 130 and the handle 140. The screwdriver 200 in accordance with the present invention, on the other hand, does not expose any middle portion of the elongated members 235, 240. With respect to the screwdriver 200 in accordance with the present invention, the handle 215 and the sleeve 230 both include retention rims 212, 222, respectively, which abut one another when the sleeve 230 is extended away from the handle 215. The abutment between the retention rims 212, 222 prevents the sleeve 230 from being separated from the handle 215. Alternatively, a single retaining ridge could be positioned on either the sleeve 230 or the handle 215 and perform a similar function.

Figure 10:
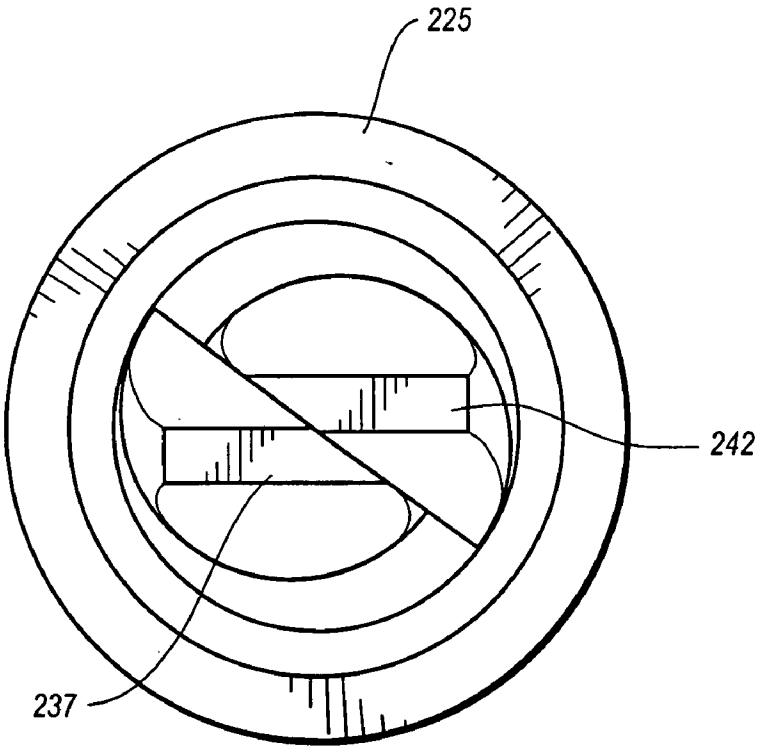
FIG. 10 is a profile view of the combined drive tip of the split-tip screwdriver illustrated in FIG. 8, wherein the drive tips overlap one another to increase the thickness of the combined drive tip.
Figure 9:
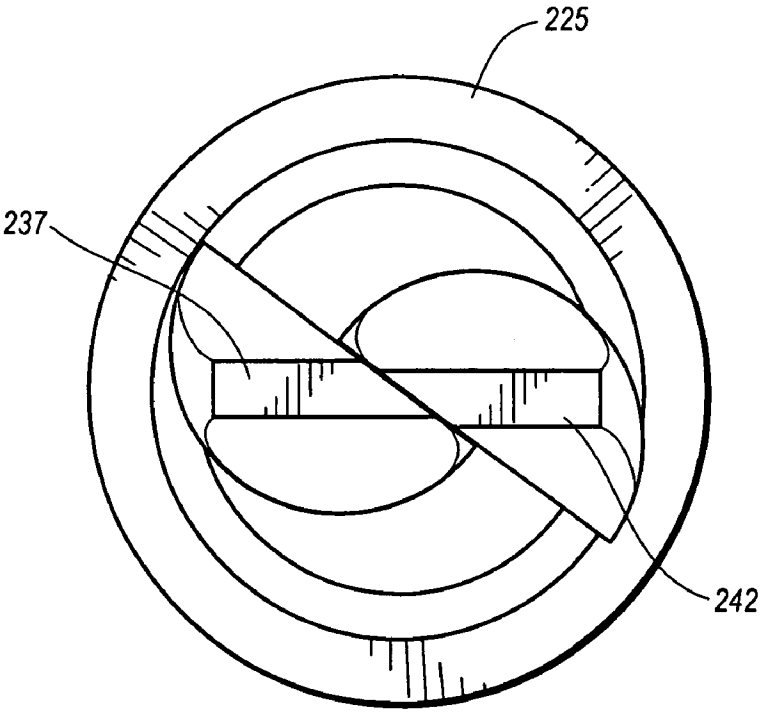
FIG. 9 is a profile view of the combined drive tip of the split-tip screwdriver illustrated in FIG. 6, wherein the combined drive tip forms a standard flat drive tip.

FIGS. 9 and 10 illustrate front views of the combined drive tip when the sleeve is positioned in the retracted and extended positions, respectively. These figures show the differences of the combined drive tip 250 when the sleeve 230 is in the retracted position (FIG. 9) and when it is in the extended position (FIG. 10). As shown, the tips 237, 242 move relative to each other along an inclined plane.

While this invention has been described with reference to certain specific embodiments and examples, it will be recognized by those skilled in the art that many variations are possible without departing from the scope and spirit of this invention. For example, one or more of the embodiments could be combined to form a single product that is consistent with the teachings of this invention. The invention, as defined by the claims, is intended to cover all changes and modifications of the invention which do not depart from the spirit of the invention. The words "including" and "having," as used in the specification, including the claims, shall have the same meaning as the word "comprising."

What is claimed is:

1. A screwdriver comprising:

a handle having hollow cavity;

a pair of elongated members having a proximal and distal end, wherein the elongated members are coupled together at their proximal ends within the handle, and wherein the distal ends form a combined drive tip;

a movable sleeve disposed over the elongated members such that when the sleeve is retracted proximally, the drive tips on the elongated members align with one another and when the movable sleeve is extended distally, the drive tips on the elongated members overlap one another; and a retaining member protruding radially from the hollow cavity, the retaining member preventing the movable sleeve from distally extending a particular distance away from the handle.

2. A screwdriver comprising:

a handle;

a pair of elongated members having a proximal and distal end, wherein the elongated members are coupled together at their proximal ends within the handle, and wherein the distal ends form a combined drive tip;

a movable sleeve disposed over the elongated members such that when the sleeve is retracted proximally, the drive tips on the elongated members align with one another and when the movable sleeve is extended distally, the drive tips on the elongated members overlap one another; and a retaining member, the retaining member preventing the movable sleeve from distally extending a particular distance away from the handle;

wherein the retaining member includes two retaining ridges, one retaining ridge is positioned on the movable sleeve and another retaining ridge is positioned on the handle.

3. The screwdriver of claim 1 wherein the movable sleeve electrically insulates all portions of the elongated members disposed between the movable sleeve and the handle.

4. The screwdriver of claim 1 wherein the handle includes a hollow cavity with a tapered entrance, and wherein the retaining member includes a recessable portion and a retaining ridge, and wherein the recessable portion is shaped to pass through the tapered entrance and move within the hollow cavity, and wherein the retaining ridge is shaped to be obstructed by the tapered entrance but be able to move within the hollow cavity.

5. The screwdriver of claim 2 wherein the retaining member remains within the handle when the movable sleeve is retracted proximally and extended distally.

6. The screwdriver of claim 1 wherein the movable sleeve comprises a high voltage insulator.

7. The screwdriver of claim 1 wherein the combined drive tip forms a straight-slot screwdriver drive tip when the movable sleeve is retracted into the hollow cavity of the handle.

8. The screwdriver of claim 1 wherein the elongated members are welded together at their proximal ends at a location corresponding to the handle.

9. A screwdriver comprising:

a handle;

a pair of elongated members having a proximal and distal end, wherein the elongated members are coupled together at their proximal ends within the handle, and wherein the distal ends form a combined drive tip;

a movable sleeve disposed over the elongated members such that when the sleeve is retracted proximally, the drive tips on the elongated members separate from one another and when the movable sleeve is extended distally, the drive tips on the elongated members overlap one another;

at least one retaining member coupled to one of the handle and the movable sleeve, wherein the movable sleeve electrically insulates all portions of the elongated members disposed between the movable sleeve and the handle when the movable sleeve is extended distally;

wherein the at least one retaining member includes two retaining ridges, one retaining ridge is positioned on the movable sleeve and another retaining ridge is positioned on the handle, and wherein the retaining ridges abut one another when the movable sleeve is extended away from the handle a particular distance.

10. A screwdriver comprising:

a handle;

a pair of elongated members having a proximal and distal end, wherein the elongated members are coupled together at their proximal ends within the handle, and wherein the distal ends form a combined drive tip;

a movable sleeve disposed over the elongated members such that when the sleeve is retracted proximally, the drive tips on the elongated members separate from one another and when the movable sleeve is extended distally, the drive tips on the elongated members overlap one another;

at least one retaining member coupled to one of the handle and the movable sleeve, wherein the movable sleeve electrically insulates all portions of the elongated members disposed between the movable sleeve and the handle when the movable sleeve is extended distally;

wherein the handle includes a hollow cavity with a tapered entrance, and wherein the at least one retaining member includes a recessable portion and a retaining ridge, and wherein the recessable portion is shaped to pass through the tapered entrance and move within the hollow cavity, and wherein the retaining ridge is shaped to be obstructed by the tapered entrance but be able to move within the hollow cavity.

11. A screwdriver comprising:

a handle having a hollow cavity and a tapered opening;

a pair of elongated members having a proximal and distal end, wherein the elongated members are coupled together at their proximal ends within the handle, and wherein the distal ends include a drive tip;

a movable sleeve disposed over the elongated members such that when the sleeve is retracted proximally, the drive tips on the elongated members separate from one another and when the movable sleeve is extended distally, the drive tips on the elongated members join together; and at least one retaining member coupled to the movable sleeve, wherein the moveable sleeve includes a recessable portion and the at least one retaining member comprises a retaining ridge, and wherein the recessable portion is shaped to pass through the tapered opening and move within the hollow cavity, and wherein the retaining ridge is shaped to be obstructed by the tapered opening but be able to move within the hollow cavity.

12. The screwdriver of claim 11 wherein the movable sleeve electrically insulates all portions of the elongated members disposed between the movable sleeve and the handle when the movable sleeve is extended distally.

13. The screwdriver of claim 11 wherein the at least one retaining member prevents the movable sleeve from distally extending a particular distance away from the handle.

14. The screwdriver of claim 11 wherein one of the at least one retaining member remains within the hollow cavity of the handle when the movable sleeve is retracted proximally and extended distally.

15. The screwdriver of claim 11 wherein the movable sleeve comprises a high voltage insulator.

16. The screwdriver of claim 11 wherein the combined drive tip forms a flat head screwdriver drive tip when the sleeve is retracted against the handle.

17. The screwdriver of claim 11 wherein the elongated members are welded together at their proximal ends within the handle.

* * * * *